US009183727B2

(12) United States Patent
Young

(10) Patent No.: US 9,183,727 B2
(45) Date of Patent: Nov. 10, 2015

(54) OBJECT TRACKING WITH PLATFORM NOTIFICATIONS

(71) Applicant: Cellco Partnership, Arlington, VA (US)

(72) Inventor: Eugene Young, New York, NY (US)

(73) Assignee: Cellco Partnership, Basking Ridge, NJ (US)

( * ) Notice: Subject to any disclaimer, the term of this patent is extended or adjusted under 35 U.S.C. 154(b) by 303 days.

(21) Appl. No.: 13/802,902

(22) Filed: Mar. 14, 2013

(65) Prior Publication Data

US 2014/0266756 A1 Sep. 18, 2014

(51) Int. Cl.
*G08B 21/00* (2006.01)
*G08B 21/24* (2006.01)

(52) U.S. Cl.
CPC ..... *G08B 21/24* (2013.01)

(58) Field of Classification Search
CPC ..... H04W 64/00
USPC ..... 340/686.6
See application file for complete search history.

(56) References Cited

U.S. PATENT DOCUMENTS

| | | | | |
|---|---|---|---|---|
| 2009/0119119 | A1* | 5/2009 | Scalisi et al. | 705/1 |
| 2010/0274691 | A1* | 10/2010 | Hammad et al. | 705/30 |
| 2011/0012743 | A1* | 1/2011 | Van Gorp et al. | 340/686.6 |
| 2012/0009904 | A1* | 1/2012 | Modi et al. | 455/413 |
| 2012/0026971 | A1* | 2/2012 | Khandelia et al. | 370/331 |

* cited by examiner

*Primary Examiner* — Hai Phan
*Assistant Examiner* — Zhen Y Wu

(57) ABSTRACT

A system may include a platform manager device including a memory and a platform application installed thereon. The platform application may be configured to cause the platform manager device to identify a last known location of a tracked device according to a detection of a disconnection of the tracked device due to lack of receipt of presence indications; identify an owner communications device, among a plurality of communications devices, to receive a platform notification message indicative of the disconnection of the tracked device according to device associations of the tracked device and the communications devices; and send the platform notification message to the identified owner communications device informing of the detected disconnection.

20 Claims, 6 Drawing Sheets

OBJECT TRACKING WITH PLATFORM NOTIFICATIONS

BACKGROUND

Lost objects may be difficult to locate. In a moment of panic, it may be tempting to search quickly and randomly. However, a rushed search may only further bury an object under something recently put down (such as today's mail), or a short distance from its proper place (such as on the floor underneath its usual spot). Sometimes, to find an object one thinks back to the last time one had it and goes there. Other times, the object is in plain sight and the owner is too upset to find it. Still other times, a lost object is where it is supposed to be, put away by another.

Various automated systems have been developed to aid in the location of objects. However, these systems suffer various difficulties, such as high power requirements, expensive remote call centers, or inconvenient methods of use.

DETAILED DESCRIPTION

Objects may be tagged with tracking devices, such that a software application executed by a communications device may collect data on the locations of the tagged objects. The data may be collected from the tagged objects regularly, and the locations of the tagged objects may be sent to a platform manager. The platform manager may be configured to provide platform notifications for tagged objects that become lost, and may also facilitate the viewing of tagged objects and last known locations on a tagged object location dashboard. The dashboard may be displayed via a communications device or in some other manner, such as by way of a web page.

Such a system may identify when tagged objects become lost, and may provide platform notifications to alert owners of the tagged objects. The platform notification may include information such as a name of the tagged object, the last known location of the tagged object, and potentially a suggested direction to head to attempt to locate the lost tagged object. For example, if a child accidentally leaves a tagged object in a particular location, the platform manager may be configured to send a platform notification to the child or to another user such as the child's parent. To facilitate use of the system, the last known location of the object may be specified in relation to a distance from a user-defined location or a point of interest, rather than as a raw position or coordinate.

Figure 1:
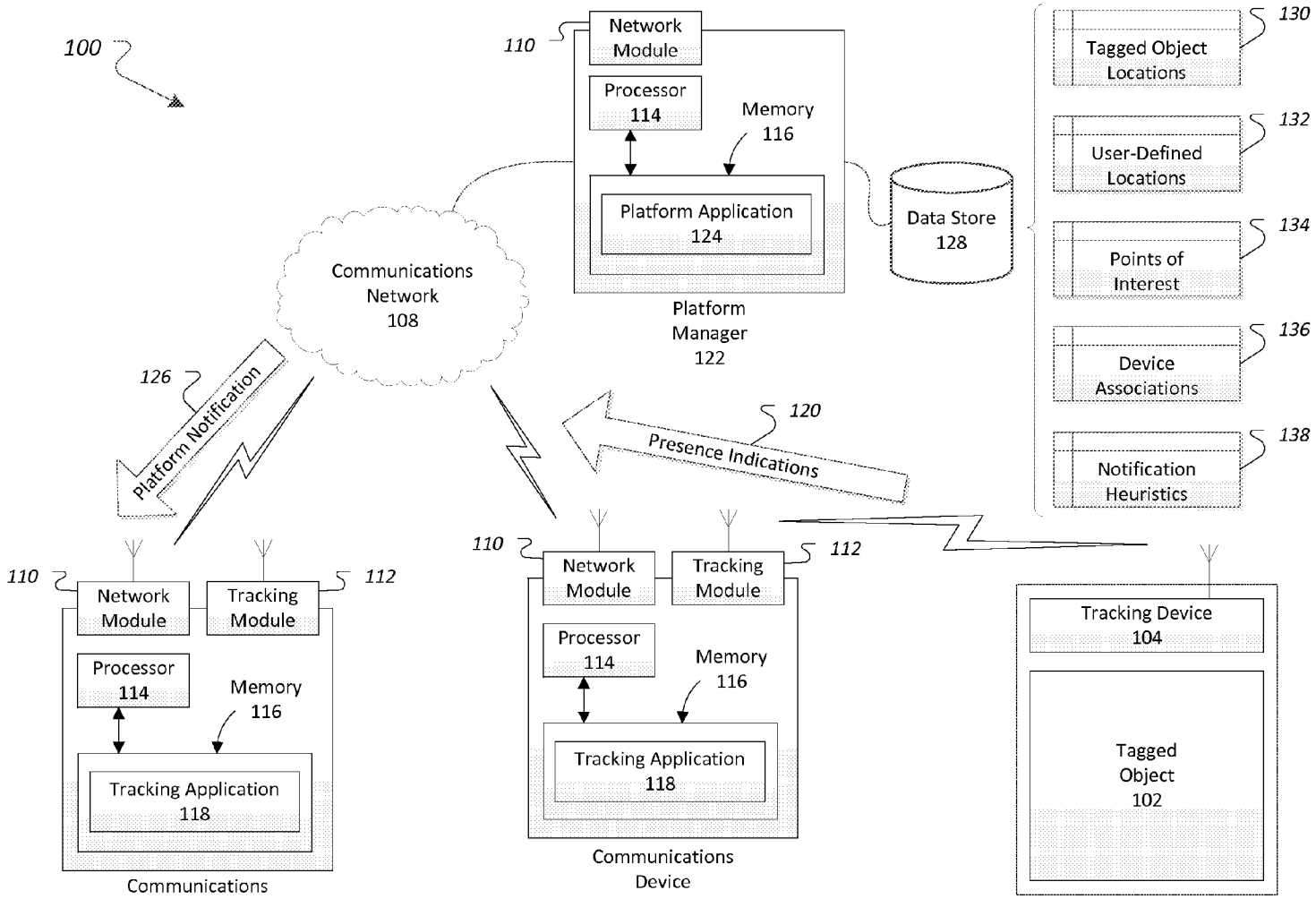
FIG. 1 illustrates an exemplary system for managing tagged objects.

FIG. 1 illustrates an exemplary system 100 for managing tagged objects 102. The system 100 may include one or more tagged objects 102, each in association with a tracking device 104. The system 100 may further include one or more communications devices 106 connected to a communications network 108. The communications devices 106 may include network modules 110, tracking modules 112, and processors 114 that execute computer instructions stored on memories 116, such as instructions of a tracking application 118. One or more of the communications devices 106 may be in selective communication with the tracking devices 104 to receive presence indications 120 regarding the tagged objects 102.

The system 100 may further include a platform manager 122 that includes a processor 114 that execute instructions stored on a memory 116, such as those of a platform application 124. The platform manager 122 may be configured to receive the presence indications 120 from the communications devices 106 over the communications network 108, analyze various informational aspects, and selectively provide platform notifications 126 when tagged objects 102 appear to be lost. With respect to the informational aspects, the platform manager 122 may be in communication with a data store 128 configured to store information such as tagged object locations 130, user-defined locations 132, points of interest 134, device associations 136 and notification heuristics 138. The system 100 may take many different forms and includes multiple and/or alternate components and facilities. While an exemplary system 100 is shown in FIG. 1, the exemplary components illustrated of the system 100 are not intended to be limiting. Indeed, additional or alternative components and/or implementations may be used.

The tagged object 102 may include any object or thing suitable for being tagged by a tracking device 104. By being tagged, the tagged object 102 may accordingly be suitable for being tracked by the system 100. Exemplary tagged objects 102 may include items of personal property such as books, gloves or wallets, or containers for items of personal property, such as book bags, purses, boxes or other items used to transport other items.

The tracking device 104 may be a device capable of providing presence indications 120, or in some cases, a device capable of responding to a request by providing a response including a presence indication 120. The presence indication 120 may include information such as an identifier of the tracking device 104 and location information indicative of tagged object locations 130 (for tags supporting such functionality).

One exemplary type of tracking device 104 may be a Bluetooth® low energy tag device implemented according to the Bluetooth® standard defined by the Bluetooth Special Interest Group (SIG). Bluetooth® low energy tags may have an effective range on order of up to approximately 45 meters (150 feet), depending on the surrounding environment; thus, tracking devices 104 utilizing Bluetooth® low energy tags facilitate tracking of tagged objects 102 according to that range. Tracking devices 104 implemented as Bluetooth® low energy tags without additional functionality may be unable to determine location information related to their positions, however.

Other exemplary types of tracking device 104 may further include functionality to allow the tracking device 104 to determine its position. As some examples, the tracking device 104 may include functionality to facilitate a determination of tracking device 104 position by way of multilateration of radio signals received from multiple communications towers of the communications network 108, according to signal strength to nearby communications towers, or through use of included global position system (GPS) functionality of the network module 110 configured to receive GPS signal information.

As a further alternative, the tracking device 104 may be configured to forward on location information determined by the tagged object 102. For instance, if the tagged object 102 is an electronic device capable of determining its position such as a tablet computer, then the tracking device 104 may be in communication with the tagged object 102 to receive and forward on the location information determined by the tagged device 102. It may also be possible in some examples for the electronic tagged object 102 capable of determining its position to perform in the role of the tracking device 104 itself, without requiring a separate tracking device 104.

The communications device 106 may be any of various models of networked devices, such as cellular phones, tablet computers, or other types of portable computing device. The communications device 106 may include a network module 110 capable of providing the communications device 106 with selective communication functionality over a communications network 108. Exemplary network modules 110 may include various code vision multiple access (CDMA) or global system for mobile communications (GSM) modules capable of communications with cellular communications networks (e.g., the Verizon Wireless 4G long-term evolution (LTE) network), or wireless local area network (WLAN) modules such as modules implementing the IEEE 802-11 wireless standard. The network module 110 may further allow the communications device 106 to determine the position of the communications device 106, such as by one or more of the approaches discussed above.

The communications device 106 may include a tracking module 112 configured to allow the communications device 106 to receive presence indication 120 and optionally other tracking information related to the tracking device 104 (e.g., tracking device 104 determined location information). The tracking module 112 may further include transmitter functionality in some examples, for example to facilitate the sending of request messages to query for tracking devices 104. An exemplary implementation of the tracking module 112 may be through use of a chipset implementing the Bluetooth® low energy portion of the Bluetooth® standard, as one example. In some examples, network module 110 and tracking module 112 are implemented by a common module (e.g., a combined WLAN and Bluetooth module), while in other examples the modules may be implemented separately.

The communications network 108 may be configured to transport data between devices on the communications network 108. For instance, the communications network 108 may provide communications services, including packet-switched network services (e.g., Internet access, VoIP communication services) and circuit-switched network services (e.g., public switched telephone network (PSTN) services) to devices connected to the communications network 108. Exemplary communications networks 108 may include the PSTN, a VoIP network, a VoLTE (Voice over LTE) network, a cellular telephone network, a fiber optic network, and a cable television network. To facilitate communications, communications devices on the communications network 108 may be associated with unique device identifiers being used to indicate, reference, or selectively connect to the identified device on the communications network 108. Exemplary device identifiers may include telephone numbers, mobile device numbers (MDNs), common language location identifier (CLLI) codes, internet protocol (IP) addresses, input strings, and universal resource identifiers (URIs). Each communications device 106 may be associated with one or more such device identifiers.

The tracking application 118 of the communications device 106 may facilitate the control of the functionality of the communications device 106, such as the network module 110 and tracking module 112, to forward or otherwise share information related to received presence indications 120 over the communications network 108. In many examples, only one communications device 106 would be in communication with a tracking device 104 associated with a tagged object 102, but in other cases it is possible for more than one communications device 106 to perform the tracking of a tracking device 104.

The platform manager 122 configured to analyze various informational aspects with respect to the various communications devices 106 and tagged objects 102 of the system 100. For example, the platform manager 122 may execute platform application 124 configured to cause the platform manager 122 to receive presence indications 120 from communications devices 106 related to tracking devices 104 in their respective vicinities, and to selectively generate and provide platform notifications 126 to owner communications devices 106 of tagged objects 102. Particulars of the generation of platform notifications 126 may be informed based on data stored by data store 128, such as tagged object locations 130, user-defined locations 132, points of interest 134, device associations 136, and notification heuristics 138.

The tagged object locations 130 may include last known locations for the tagged objects 102 being tracked. These locations may be determined from location data included in received presence indications 120. In some examples, the last known locations may include location information determined by tracking devices 104 and forwarded to the platform manager 122 by communications devices 106. In these examples, the last known locations may be indicated with an error bound related to the margin of error of the mechanism used to determine the location (e.g., a margin of error of on the order of 20 meters (66 ft) for GPS).

In examples where the communications device 106 may include location determining functionality but the tracking device 104 may not, the last known tagged object locations 130 of the tagged object 102 may actually be the locations of the communications devices 106 determined by the communications devices 106 the last time that the tracking device 104 associated with the tagged object 102 was responsive. In such an example, the tagged object locations 130 may be identified with a larger margin of error according to the effective range of the technology of the utilized tracking device 104 (i.e., how far the tagged object 102 may be from the communications device 106) in addition to the margin of error of the location mechanism itself. To use Bluetooth® low energy tags as an example, an exemplary additional margin of error of the last known location of the tagged object 102 due to the tracking device 104 may be on the order of 30-45 meters (100-150 feet) outdoors and perhaps 9-15 meters (30-50 feet) indoors due to obstacles between the tracking device 104 and the communications device 106. Nevertheless, as by definition the tracking device 104 was reachable by the communications device 106 at the last known location, recording tagged object locations 130 of the last known locations for the tagged objects 102 facilitates the tracking and recovery of the tagged object 102.

The tagged object locations 130 may further include time information related to the last known locations. In some cases, the data store 128 may preserve a history of locations of tagged object 102. This historical information may be used for later analysis, such as to identify that a tagged object 102 is not in its typical location for a certain time of day, that the tagged object 102 is not in the vicinity of the communications device 106 it should be with, or to extrapolate a potential location of the tagged object 102 based on travel trends (e.g., speed and direction of travel when last identified). The tagged object locations 130 may be updated in the data store 128 based on presence indications 120 received by the communications devices 106 and forwarded to the platform manager 122 for further processing.

The user-defined location 132 may include associations of friendly names for locations with geographic coordinates or other geographic boundaries. For example, a particular geographic latitude and longitude may be associated with a friendly name such as "Home", "Office" or "School". The platform application 124 may make use of the user-defined location 132 information to provide appropriate names as specified by a user of the system 100.

The points of interest 134 may include system associations of friendly names for locations with geographic coordinates or other geographic boundaries. As an example, the Empire State Building in New York City may be associated as a point of interest with address information (e.g., 43 W. 33rd Street) or geographic coordinate information (e.g., 40.748842, −73.987073.) In some cases, to provide a more complete listing of points of interest 134, the platform manager 122 may be configured to access an external point of interest 134 data store or service, such as one or more of the point of interest services provided by mapping services such as Google Maps, Bing Maps, or Nokia Maps. For instance, the system may make use of an interface of a mapping service configured to receive geographic coordinates, and to return points of interest 134 in the area of the provided coordinates, such as names and locations of landmarks or stores nearby the received geographic coordinates.

A location of the tracking device 104 may be specified according to a distance from a user-defined location 132 or point of interest 134 (e.g., "about 300 feet west of 'Work'"). To do so, the platform application 124 may identify a close or closest user-defined location 132 or point of interest 134 to a location, and may determine the distance and direction according various types of calculation. One exemplary type of calculation to determine distance and direction from two points on the earth from their respective latitude and longitude coordinates is to use the Haversine navigation formula. Another exemplary way to determine a distance between two points may be to employ routing technologies available to the communications device 106, such as determination of a path or route by a navigation application of the communications device 106.

The platform application 124 may accordingly make use of the user-defined location 132 and point of interest 134 information to provide useful names for location data, rather than relying on raw geographic coordinates.

The device associations 136 may include information serving to identify the relationship of tagged objects 102 with the communications devices 106. For instance, a tagged object 102 may have one or more associated communications devices 106, where the associated communications devices 106 are configured to track the tagged object 102 according to the tracking device 104. In cases where multiple communications devices 106 are configured to track the tagged object 102, one of these communications devices 106 may be designated as a primary tag owner. Others of the communications devices 106 may be designated as secondary or tertiary owners. As a specific example, a tagged object 102 may be a book bag of a child, and the smartphone communications device 106 of the child may be the primary tag owner. The communications device 106 of a father of the child may be indicated as being a secondary tag owner, and the communications device 106 of a mother of the child may be indicated as being a tertiary tag owner.

The platform application 124 may make use of the device associations 136 to facilitate the generation and provisioning of platform notifications 126 to owner communications devices 106. For example, if the platform application 124 identifies that presence indications 120 are no longer being received for a tagged object 102 by an associated communications device 106 previously receiving the presence indications 120 (and that no other associated communications device 106 have begun receiving the presence indications 120), the platform application 124 may cause the platform manager 122 to access the device associations 136 to identify communications devices 106 that should receive platform notifications 126 regarding the last known tagged object location 130 of the lost tagged object 102.

The notification heuristics 138 may include information suitable for configuring the operation of the platform application 124 to generate the platform notifications 126. As some examples, the notification heuristics 138 may include a predetermined amount of time of not receiving presence indications 120 or a number of missed presence indications 120 serving to trigger the generation of a platform notification 126.

The notification heuristics 138 may also include information indicative of which of the owner communications devices 106 as identified by the device associations 136 should receive the platform notifications 126. As some example, the notification heuristics 138 may indicate for all owner communications devices 106 to receive platform notifications 126, for the owner communications devices 106 to receive platform notifications 126 in a particular order, for only a subset of the owner communications devices 106 to receive platform notifications 126 (e.g., only primary or only secondary owners, only certain owner devices according to time period), or for the owner communications devices 106 to receive platform notifications 126 according to information as specified in the device associations 136.

In some cases, the notification heuristics 138 may further include time limitations with respect to when which owner communications devices 106 should receive the platform notifications 126. As an example, the notification heuristics 138 may specify that a particular owner communications device 106 is unavailable or otherwise should not receive notifications during certain time periods (e.g., during work) or at certain locations (e.g., at a doctor's office). As another example, the notification heuristics 138 may be configured to define shifting of notifications when a particular owner communications device 106 should not receive notifications, such as indicating one or more other communications devices 106 to receive the notifications instead of the communications device 106 that should not receive notifications.

The notification heuristics 138 may also include settings with respect to factors to consider before sending a platform notification 126. As some examples, the notification heuristics 138 may include an amount of time to wait after not receiving presence indications 120 before sending platform notifications 126, or for an amount of periodic presence indications 120 that may be missed before sending platform notifications 126.

As another example, the notification heuristics 138 may include indications of locations (e.g., user-defined locations 132, points of interest 134, geographic coordinates) for which platform notifications 126 should be suppressed. A listing of such locations may be useful to prevent an owner communications device 106 from receiving notifications about a tagged object 102 that loses contact with an owner communications device 106 while at home (e.g., when a user turns off his or her communications device 106, when a user roams around his or her home). As another possibility, the notification heuristics 138 may include a longer an amount of time to wait after not receiving presence indications 120 before sending platform notifications 126, or for a larger amount of periodic presence indications 120 that may be missed before sending platform notifications 126 when at certain designated locations.

Figure 2:
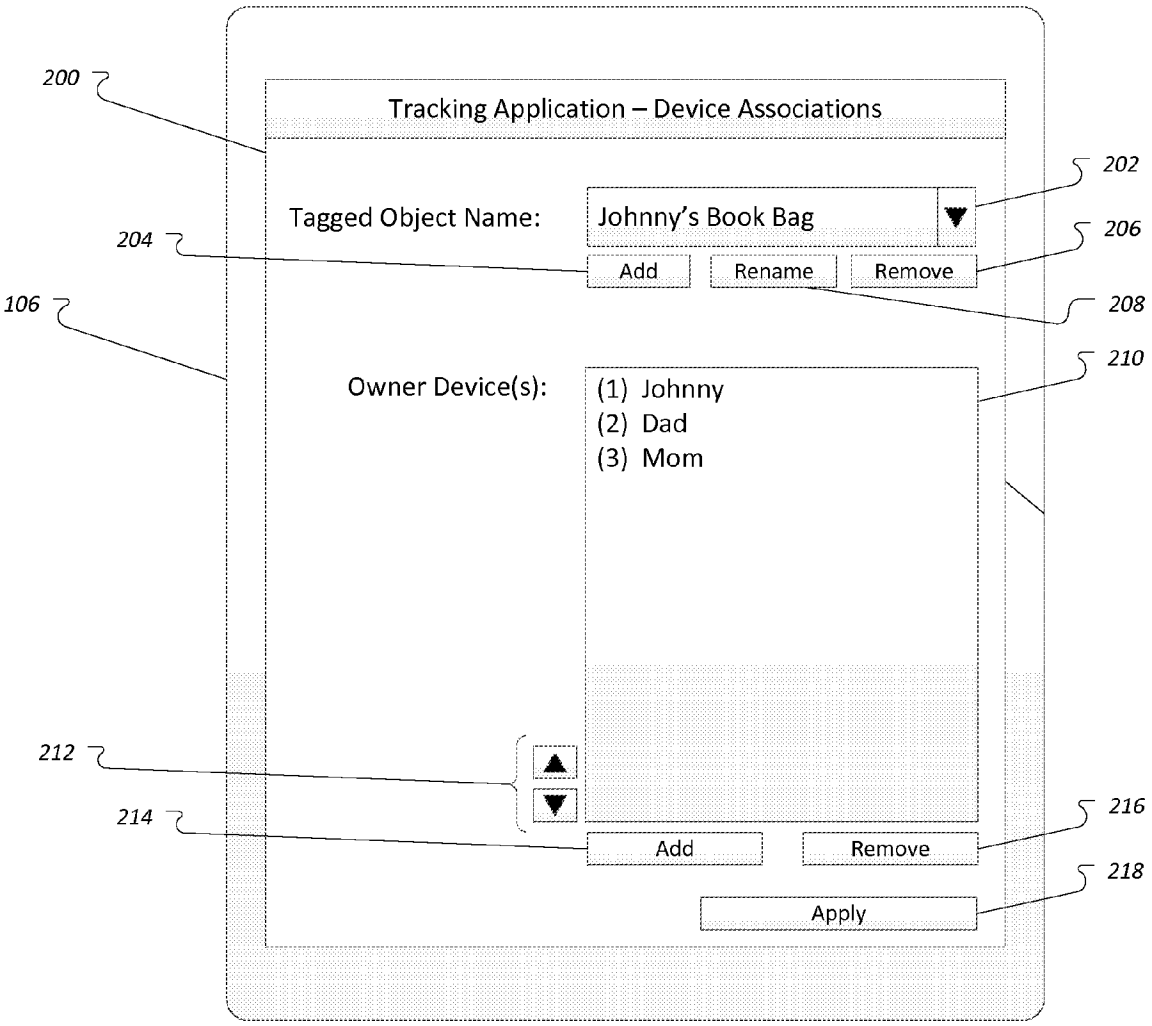
FIG. 2 illustrates an exemplary user interface for maintenance of device associations between tagged objects and communications devices.

FIG. 2 illustrates an exemplary user interface 200 for maintenance of device associations 136 between tagged objects 102 and communications devices 106. The user interface 200 may be provided, for example, by the tracking application 118 executed by a communication device 106 operating in selective communication with the platform manager 122. As illustrated, the user interface 200 includes a tagged object control 202 configured to provide for selection of tagged objects 102. The user interface 200 further includes an owner devices control 210 configured to provide for the selection of communications devices 106 to be associated with the selected tagged object 102.

To select a tagged object 102 for configuration, a user may select from a listing of tagged objects 102 in the tagged object control 202. For example the user may select a dropdown arrow or use some other mechanism to make a selection of a tagged object 102 tracked by the system 100. In some examples, the listing of tagged objects 102 may be retrieved in response to a query by the tracking application 118 to the platform manager 122 for device associations 136 stored by the data store 128. In some examples, the listing of tagged objects 102 may also include information indicative of device associations 136 stored locally on the communications device 106. In the exemplary tagged object control 202, a tagged object 102 associated with the name "Johnny's Book Bag" is indicated as being selected for configuration.

If a user does not see in the dropdown list or otherwise wishes to add a new a tagged object 102 to the system 100, the user may select the add control 204. Upon selection of the add control 204, the tracking application 118 may facilitate the pairing of the communications device 106 with a tracking device 104 of a tagged object 102 to be added to the system 100 for tracking. For example, the pairing process may involve one or more of: placing the tracking device 104 and communications device 106 in close proximity, configuring one or more of the tracking device 104 and communications device 106 to be visible for device discovery, placing one or more of the tracking device 104 and communications device 106 in a connection mode to facilitate device discovery, entering a passcode or challenge-accept code into one or more of the tracking device 104 and communications device 106, and utilizing a secondary mechanism such as near-field communication to effectuate a device pairing. The tracking application 118 may further allow a name for the tagged object 102 to be entered into the system 100 to facilitate its identification.

If the user desires to remove a tagged object 102 from the system 100, the user may select the remove control 206. If the user desires to rename the tagged object 102, the user may select the rename control 210, and may enter a new name when prompted by the tracking application 118.

The owner devices control 210 may include a configurable list of the communications devices 106 related to the tagged object 102 selected in the tagged object control 202. The configurable list of the communications devices 106 may indicate a listing of the communications devices 106 that are configured or otherwise authorized to perform tracking of the tracking device 104 of the selected tagged object 102.

In some examples, the configurable list of the communications devices 106 may identify the owner communications devices 106 that may be informed of platform notifications 126 related to the tagged object 102. For example, owner communications devices 106 named "Johnny", "Dad", and "Mom" are listed in the owner devices control 210 as being associated with the "Johnny's Book Bag" tagged object 102. Moreover, an ordering of the owner communications devices 106 is also included in the exemplary listing. In some examples, the ordering of the communications devices 106 may be used to indicate an order in which the owner communications devices 106 should receive platform notifications 126 from the system. In other examples, the ordering may not be relevant, and the communications devices 106 may receive the platform notifications 126 at substantially the same time. As illustrated, the ordering controls 212 may be utilized by a user to adjust the ordering of selected owner communications devices 106 in the owner devices control 210.

The configurable list of the communications devices 106 may also identify additional notification heuristics 138 with respect to the notification of owner communications devices 106. For instance, the configurable list may allow a user to designate a communications device 106 as having primary owner responsibility over a tagged device 102 during certain periods of time or at certain locations. For example, the configurable list may be configured to receive information indicative of a child communication device 106 having primary responsibility for a tagged object 102 during school hours or when the tagged object 102 is at a location such as the school. Moreover, the configurable list may be configured to allow a user to designate a communications device 106 of the father as the primary owner of the tagged object 102 before school (e.g., if the father drops the child off), and further designate a communications device 106 of the mother as the primary owner of the tagged object 102 after school (e.g., if the mother picks the child up after school). This timing information may be utilized, for instance, as an aid in determining whether a tagged object 102 was properly handed off to the communications device 106 at a time or location where a handoff should have occurred, or for determining which owner devices should receive platform notifications 126 at what times of day.

If the user desires to add a new owner communications device 106 to the owner devices control 210, the user may select the add control 214. The add control 214 may cause the user interface 200 to provide a facility for selection of one or more communications devices 106 to be added. As an example, the user interface 200 may allow the user to enter a telephone number or other identifier of an owner communications device 106 to be added. As another example, the user interface 200 may provide the user with a listing of devices that may be added, such as other devices with the same billing information or otherwise associated with the communications device 106 executing the tracking application 118 to provide the user interface 200. As yet a further example, to add a device the user interface 200 may allow the user to perform a pairing operation with an identified communications device 106 in the proximity of the communications device 106 executing the tracking application 118 to provide the user interface 200. If the user desires to remove an owner communications device 106 from the owner devices control 210, the user may select the communications device 106 or communications devices 106 to remove and select the remove control 212.

Once the user is satisfied with the device associations 136, the user may select the apply control 220 to apply the changes to the device associations 136 of the data store 128.

Figure 3:
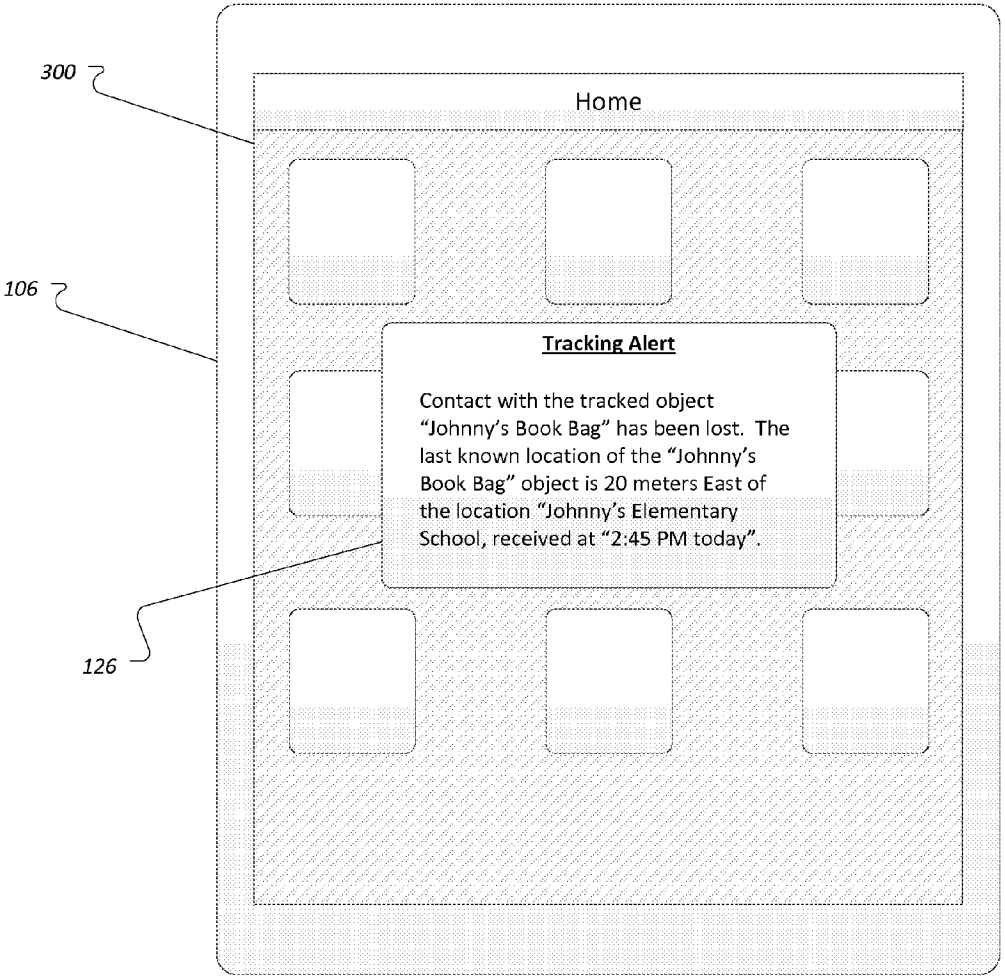
FIG. 3 illustrates an exemplary user interface for provisioning of a platform notification.

FIG. 3 illustrates an exemplary user interface 300 for provisioning of platform notifications 126. As illustrated, an exemplary platform notification 126 may be displayed in the user interface 300 of an owner communications device 106. The owner communications device 106 may be identified to receive platform notification 126 related to a tagged object 102 according to the device associations 136 of the tagged object 102. When a platform notification 126 is received by the owner communications device 106, such as upon a determination by the platform manager 122 that the tagged object 102 cannot be located, the platform notification 126 may be displayed in the user interface 300.

The platform notification 126 may indicate various elements of information related to the tagged object 102. As some examples, items of text of the platform notification 126 may indicate the name of the tagged object 102, the last known location of the tagged object 102 (or the last known location of the communications device 106 when the tagged object 102 was identified by the communications device 106), and the last time that the tagged object 102 was identified by the communications device 106. In some cases, the last known location of the tagged object 102 may be specified in terms of a user-defined location 132 or a point of interest 134 (e.g., as a direction and distance away from a user-defined location 132 or a point of interest 134 near the last known tagged object location 130, as a path or route determined according to various routing technologies employed by a navigation system, etc.).

As illustrated, the platform notification 126 indicates that the tagged object 102 named "Johnny's Book Bag" has been lost. The platform notification 126 also includes an indication of the last known location of the tagged object 102, specified in relation to a named location retrieved from the data store 128. For example, rather than specifying the location of the tagged object 102 as GPS or latitude/longitude coordinates, the platform manager 122 identified the tagged object 102 as being closest to the user-defined location 132 named "Johnny's Elementary School", and further determined the location for the platform notification 126 as a distance from that user-defined location 132.

In some examples, additional information may be included in the platform notifications 126 as well. For example, the platform manager 122 may determine the location of the communications device 106 receiving the platform notification 126, and may determine a suggested heading based on the location of the communications device 106 that may be used by the user of the communications device 106 to retrieve the lost tagged object 102. In the case of a platform notification 126 that should be sent to multiple different communications devices 106 according to the device associations 136, the platform manager 122 may determine and provide different suggested headings to the different communications devices 106 according to their respective locations.

In some examples the platform notifications 126 may further include additional content, such as a link or other mechanism to bring up a map or tagged object location dashboard including the last known location of the tagged object.

Figure 4:
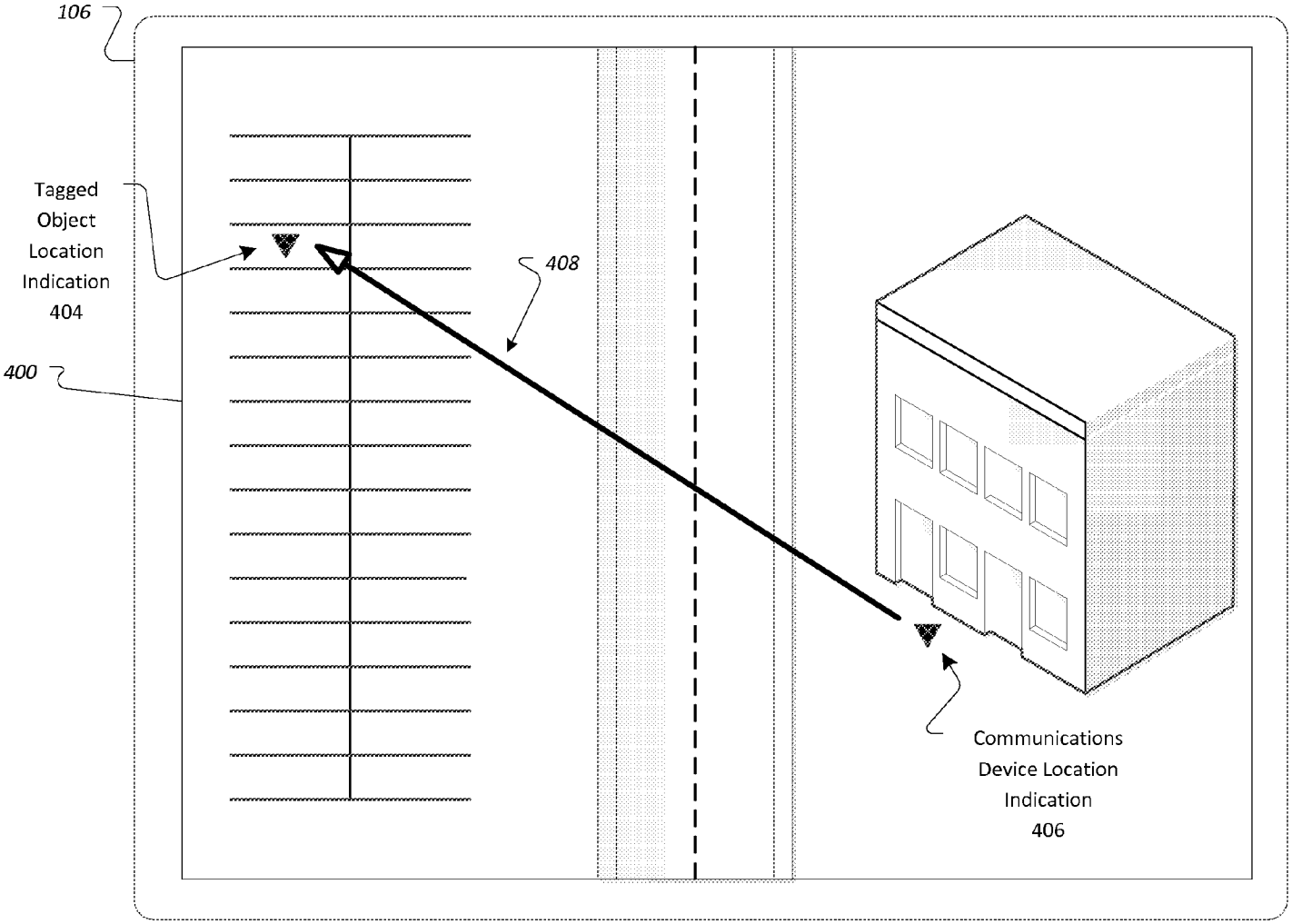
FIG. 4 illustrates an exemplary user interface for the display of a tagged object location dashboard.

FIG. 4 illustrates an exemplary user interface 400 for the display of a tagged object 102 location dashboard 402. The dashboard 402 may include a display of a map as well as the tagged object locations 130 of any tagged objects 102 located within the map. The locations of the tagged objects 102 as indicated on the map may be referred to as tagged object 102 location indications 404. As shown in the exemplary dashboard 402, a single tagged object 102 location indications 404 is illustrated, but the display of more (or potentially fewer) tagged objects 102 is possible.

In some cases, the tagged objects 102 may be illustrated on the map accompanied by bounding regions (e.g., a circle around the tagged objects 102) indicative of the margin of error of the tagged object locations 130. This error bound may be indicative of a margin of error of the underlying location mechanism used to determine the tagged object 102 locations. The error bound may also be indicative of any additional margin of error according to the effective range of the technology of the utilized tracking device 104 (i.e., how far the tagged object 102 may be from the communications device 106).

The dashboard 402 may further include additional information. For example, the dashboard 402 may include the location of the communications device 106 itself. As shown, the location of the communications device 106 displaying the dashboard 402 is indicated at the communications device 106 location indication 406. In some examples, such as if the dashboard 402 is displayed based on receipt of a platform notification 126 indicating a lost tagged object 102, the dashboard 402 may also include a suggested direction indication 408 indicative of a path or route for the user of the communications device 106 to take to locate the lost tagged object 102. In some cases, the path or route may be determined according to various routing technologies, such as those employed by a vehicular navigation system. The dashboard 402 may further include implement a roaming tracking mode in which the user of the communications device 106 is directed along the suggested path, and the communications device 106 scans and listens for an indication of the lost tagged object 102 as the user travels.

Figure 5:
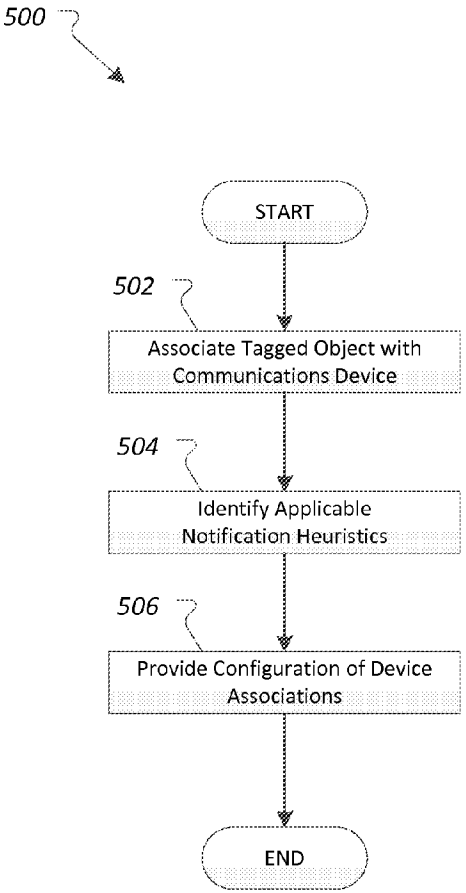
FIG. 5 illustrates an exemplary process for pairing of communications devices with tagged objects.

FIG. 5 illustrates an exemplary process 500 for pairing of communications devices 106 with tagged objects 102. The process 500 may be performed by various devices, such as by a communications device 106 executing a tracking application 118 and in communication over a communications network 108 with a platform manager 122 executing a platform application 124.

In block 502, the communications device 106 executing the tracking application 118 associates a tagged object 102 with an owner communications device 106. For example, the user interface 200 for the maintenance of device associations 136 may receive a selection of a tagged object 102, as well as an association of one or more owner communications devices 106 with the tagged object 102.

In block 504, the communications device 106 executing the tracking application 118 identifies any notification heuristics 138 applicable to the tracking of the tagged object 102. For example, the user interface 200 for the maintenance of device associations 136 may receive information indicative of which communications device 106 are primary, secondary, or tertiary owners. As one possibility, the notification heuristics 138 may specify that a communications device 106 of a child may be designated as the primary owner of a tagged device 102 when the child has primary responsibility for the tagged object 102, such as during school hours or when the tagged object 102 is at a location such as the school. Moreover, a communications device 106 of the father may be designated as the primary owner of the tagged object 102 before school (e.g., if the father drops the child off), and a communications device 106 of the mother may be designated as the primary owner of the tagged object 102 after school (e.g., if the mother picks the child up after school). The communications device 106 may further identify other notification heuristics 138 with respect to factors to consider before sending a platform notification 126 (e.g., an amount of time to wait since hearing from a tagged object 102 before sending platform notifications 126, locations for which platform notifications 126 should be suppressed, etc.) These notification heuristics 138 may be utilized by the system 100, for example, to identify which owner devices 106 may receive platform notifications 126 if the tagged object 102 becomes misplaced, or to identify which owner communications device 106 should be receiving presence indications 120.

In block 506, the communications device 106 executing the tracking application 118 provides the configuration of device associations 136 to the data store 128. For example, upon receiving an indication to apply the device associations 136 via the user interface 200, the communications device 106 executing the tracking application 118 may be configured to submit the device associations 136 to the data store 128 for use by the system 100. After block 504, the process 500 ends.

Figure 6:
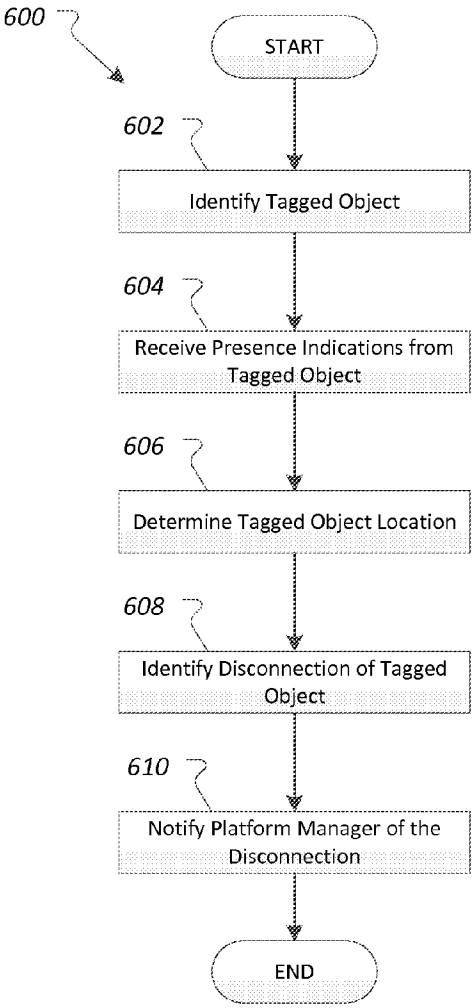
FIG. 6 illustrates an exemplary process for provisioning of presence notifications.

FIG. 6 illustrates an exemplary process 600 for provisioning of presence indications 120. As with the process 500, the process 600 may be performed by various devices, such as one or more communications devices 106 executing a tracking application 118 in communication with a platform manager 122 executing a platform application 124.

In block 602, the communications device 106 identifies a tagged object 102 to be tracked. For example, the tracking application 118 may be configured to listen using the tracking module 112 for local tracking devices 104 corresponding to or otherwise associated with tagged objects 102 that may be tracked. The tracking application 118 may query the platform manager 122 over the communications network 108 using the network module 110 to receive device associations 136 information indicative of which tagged objects 102 are to be tracked, e.g., during what times or at what locations. In other examples, the tracking application 118 may simply be configured to track whatever tagged objects 102 are within range of the tracking device 104 of the communications device 106.

In block 604, the communications device 106 receives a presence indication 120 from the tagged object 102. For example, presence indications 120 may be periodically sent by the tracking devices 104 corresponding to the tagged object 102. The tracking application 118 may be configured to use the tracking module 112 to listen for these presence indications 120. In some cases, the tracking application 118 may be configured to use the tracking module 112 to send requests to query for tracking devices 104, and to further listen for presence indications 120 provided in response.

In block 606, the communications device 106 determines a tagged object location 130 for the tagged object 102. For example, the tracking application 118 may be configured to identify a location of the tagged object 102 according to location information included in the received presence indications 120. In other examples, the tracking application 118 may be configured to determine the location of the communications device 106, and to use that as the tagged object location 130 by proxy. In some cases, the identified location of the tagged object 102 may be provided to the data store 128 to facilitate the tracking of the locations of the tracked objects 102.

In block 608, the communications device 106 identifies disconnection of the tagged object 102. For example, the tracking application 118 may be configured to identify that no presence indications 120 have been recently received from the tracking device 104 corresponding to the tagged object 102. The tracking application 118 may be configured to determine that the tagged object 102 is disconnected according to notification heuristics 138 received from the data store 128. As some examples, the tagged object 102 may be determined to be lost according to a lack of receipt of a predetermined number of periodic presence indications 120, a lack of receipt of a presence indication 120 from the tracking device 104 corresponding to the tagged object 102 for at a predetermined amount of time, or that the communications device 106 has made a significant change in location after which presence indications 120 have not been received.

In block 610, the communications device 106 notifies the platform manager 122 of the disconnection of the tagged object 102. For example, the tracking application 118 may be configured to cause the network module 110 of the communications device 106 to notify the platform manager 122 of the determined disconnection of the tagged object 102. After block 608, the process 600 ends.

Variations on the process 600 may be possible. For example, rather than performing the identification of disconnection of the tagged object 102 and notification of the platform manager 122 described above with respect to blocks 608 and 610, the communications device 106 may instead forward any received presence indications 120 to the platform manager 122 without making a determination of disconnection. The platform manager 122 may then receive the presence indications 120, and may perform the identification of disconnection of tagged objects 102 similar to as discussed above. By using the platform manager 122 to make the determination, a tagged objects 102 that is no longer being tracked by communications device 106 may be identified as being tracked by a different communications device 106, rather than prematurely being determined as being lost.

Figure 7:
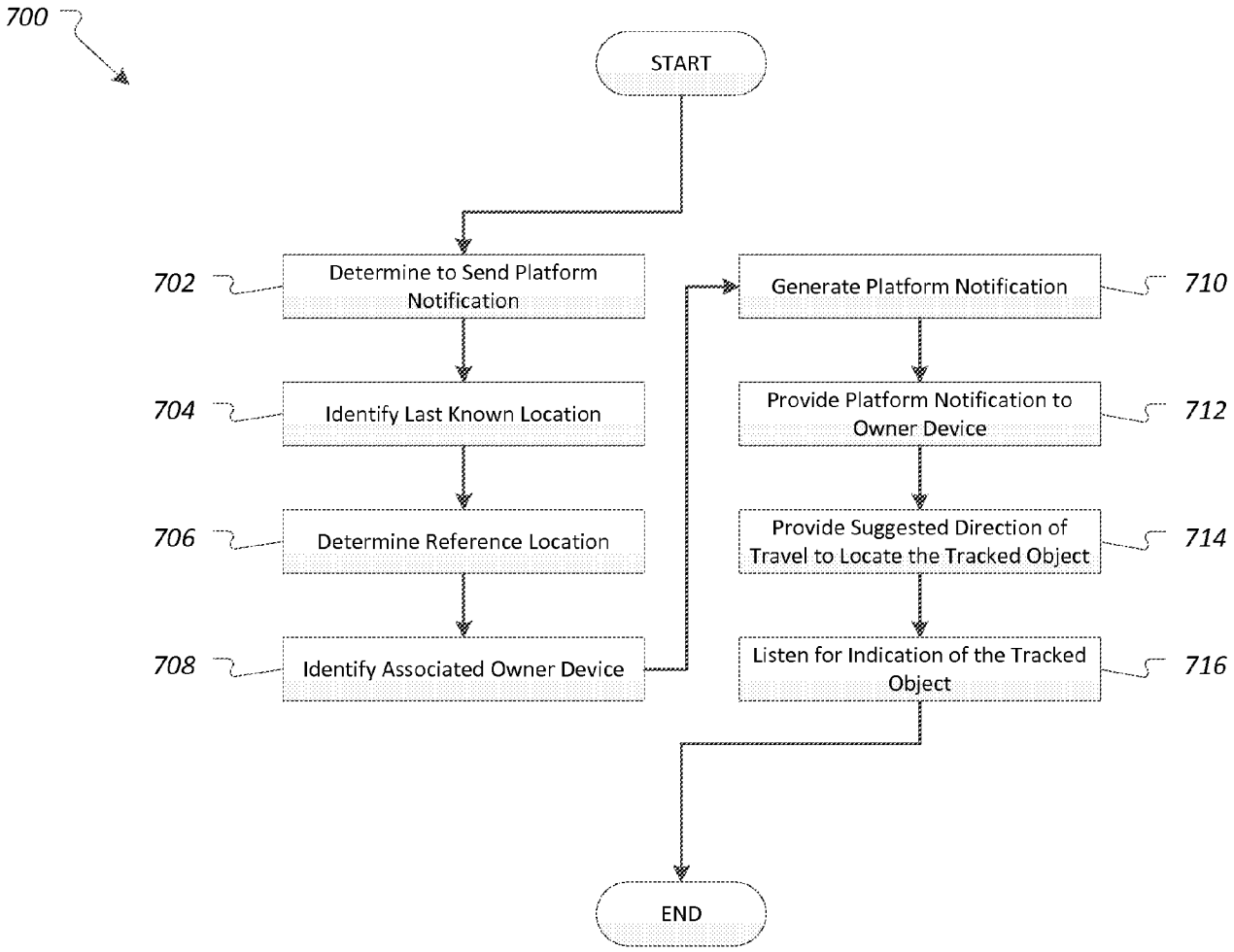
FIG. 7 illustrates an exemplary process for provisioning of platform notifications.

FIG. 7 illustrates an exemplary process 700 for provisioning of platform notifications 126. As with the processes 500 and 600, the process 700 may be performed by various devices, such as one or more communications devices 106 executing the tracking application 118 in communication with a platform manager 122 executing platform application 124.

In block 702, the platform manager 122 determines that a platform notification 126 is to be sent. For example, the platform application 124 of the platform manager 122 may receive a determination of disconnection of the tagged object 102 from a communications device 106, or may itself determine disconnection of the tagged object 102 based on received presence indications 120. Based on the determination of disconnection of the tagged object 102, the platform manager 122 may further determine that a platform notification 126 should be sent. For example, the platform application 124 may direct the platform manager 122 to query the data store 128 for device associations 136 of the tagged object 102 to determine if there are any associated owner communications devices 106 that should receive a platform notification 126 upon an identified disconnection of the tagged object 102.

In block 704, the platform manager 122 identifies a last known location of the tagged object 102. For example, the platform application 124 of the platform manager 122 may query the data store 128 for a tagged object location 130 associated with the tagged object 102. In other examples, the platform manager 122 may query for the device associations 136 related to the tagged object 102 to identify communications devices 106 associated with the tagged object 102, and then may request any last known tagged object location 130 information related to the tagged object 102 from the identified communications devices 106. The last known tagged object location 130 information may include, for example, geographic coordinates received from the tracking device 104 associated with the tagged object 102.

In block 706, the platform manager 122 determines a reference location. For example, the platform application 124 of the platform manager 122 may query the data store 128 for a user-defined location 132 or a point of interest 134 close to the last known tagged object location 130. Upon locating a user-defined location 132 including or otherwise matching the last known tagged object location 130, the platform manager 122 may determine the reference location according to name information associated with the identified user-defined location 132 or point of interest 134. In some cases, the platform manager 122 may further determine a distance or direction away from the reference location to provide a more useful output.

In block 708, the platform manager 122 identifies an associated owner communications device 106. For example, the platform application 124 of the platform manager 122 may query the data store 128 for device associations 136 related to the tagged object 102. Based on the device associations 136, the platform application 124 of the platform manager 122 may identify one or more owner communications devices 106 to receive notifications regarding the status of the tagged object 102 (e.g., at the current time, at the current communications device 106 locations, etc.). For example, the platform application 124 of the platform manager 122 may identify one or more owner communications devices 106 according to the ordering of owner communications devices 106 in the device associations 136 associated with the tagged object 102. As additional examples, the platform application 124 of the platform manager 122 may identify the owner communications device 106 associated with the tagged object 102 that is closest to the communications device 106 that most recently reported the location of the tagged object 102 as the owner communications device 106 or that is a designated owner communications device 106 to receive platform notifications 126 at the time of identification of the tagged object 102 as misplaced.

In block 710, the platform manager 122 generates a platform notification 126. For example, the platform application 124 of the platform manager 122 may generate a platform notification 126 including information about the tagged object 102. The information to include in the platform notification 126 may include, as some examples, the reference location, a last known location of the tagged object 102, and a time at which the last known location of the tagged object 102 was recorded.

In block 712, the platform manager 122 provides the platform notification 126 to the associated owner communications device 106. For example, the platform application 124 of the platform manager 122 may direct the network module 110 of the platform manager 122 to send the platform notification 126 to the identified associated owner communications device 106. The platform notification 126 may be displayed as a message on the communications device 106 such as illustrated above with respect to the user interface 300. The platform notification 126 may further cause the communications device 106 to invoke a dashboard 400 such as illustrated above with respect to the user interface 400.

In block 714, the platform manager 122 optionally provides a suggested direction of travel to the associated owner communications device 106 to locate the tagged object 102. For example, based on the last known location of the tagged object 102 and the location of the associated owner communications device 106, the platform manager 122 may suggest a direction of travel for a user of the associated owner communications device 106 to take to attempt to locate the tagged object 102. As another example, the platform manager 122 may suggest a direction of travel for a user of the associated owner communications device 106 informed according to a history of previous locations of the communications devices 106 to which the tagged object 102 was paired or otherwise being tracked. As yet a further example, to increase coverage the different suggested directions may be provided to various owner communications devices 106 associated with the tagged object 102.

In block 716, the platform manager 122 listens for an indication of the tracked object 102. For example, based on the provided suggestion on a direction of travel to the associated owner communications device 106 to locate the tagged object 102, the platform manager 122 may listen to see if any communications device 106 report a presence indication 120 associated with the tagged object 102. Thus, the communication devices 106 may enter a roaming tracking mode to listen for an indication of the tagged object 102 while scanning for the tagged object 102 according to suggested direction of travel. By listening for presence indications 120 according to the specified search directions, the tagged object 102 may potentially be found. After block 716, the process 600 ends.

By using the services of the platform manager 122, users may utilize their communications devices 106 to selectively track tagged objects 102 as well as to locate tagged objects 102 that may have become lost. As an exemplary application of the system 100, in the morning a child may be dropped off to school. The child's communications device 106 may accordingly be paired to a backpack of the child to facilitate the tracking of the backpack tagged object 102 by the system 100. Upon an afternoon pickup of the child by a parent or guardian, the backpack tagged object 102 may be left inside the school. As a result the backpack tagged object 102 will become disconnected from the child's communications device 106, thereby causing presence indications 120 related to the backpack tagged object 102 to cease. The platform manager 122 may detect that presence indications 120 have ceased, and may send a platform notification 126 to the parent or guardian's communications device 106 indicating that the backpack tagged object 102 may have been misplaced. The platform notification 126 may further include an indication of the last known location of the backpack tagged object 102 according to the user-defined locations 132 and/or points of interest 134 (e.g., the backpack tagged object 102 was last located at the "School" location.) The platform manager 122 may further provide a suggested direction to the parent or guardian to facilitate the location of the backpack tagged object 102. For example, the platform manager 122 may direct the parent or guardian back towards the school.

In general, computing systems and/or devices, such as the communications devices 106 and the platform manager 122, may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OS X and iOS operating systems distributed by Apple Inc. of Cupertino, Calif., the BlackBerry OS distributed by Research In Motion of Waterloo, Canada, and the Android operating system developed by the Open Handset Alliance.

Computing devices such as the communications devices 106 and the platform manager 122 generally include computer-executable instructions such as the instructions of the tracking application 118 and platform application 124, where the instructions may be executable by one or more processors 114. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor or microprocessor receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computing device). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores 128 described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein. The tracking application 118 and platform application 124 may be such computer program products. In some example, the tracking application 118 and platform application 124 may be provided as software that when executed by one or more processors 114 provides the operations described herein. Alternatively, the tracking application 118 and platform application 124 may be provided as hardware or firmware, or combinations of software, hardware and/or firmware.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A platform manager device, comprising:

a processor;

a memory; and a platform application installed on the memory, wherein the platform application is configured to be executed by the processor to cause the platform manager device to:

designate a communications device as being responsible for an object during a user-defined time period, the object being associated with a tracked device;

identify a last known location of the tracked device according to a detection of a disconnection of the tracked device due to lack of receipt of presence indications;

identify, during the user-defined time period, the responsible communications device to receive a platform notification message indicative of the disconnection of the tracked device according to device associations of the tracked device and the communications device; and send the platform notification message to the identified owner communications device informing of the detected disconnection.

2. The platform manager device of claim 1, wherein the platform notification message is configured to cause the identified communications device to display a tagged object location dashboard including: a map, a last known location of the tracked device on the map, and a location of the communications device on the map.

3. The platform manager device of claim 1, wherein the platform application is further configured to cause the platform manager device to:

pair the tracking device and the communications device using near-field communication;

periodically receive presence indications from the tracked device while the tracking device and the communications device are paired; and maintain a last known tagged object location of the tracked device according to the periodically received presence indications.

4. The platform manager device of claim 3, wherein the platform application is further configured to cause the platform manager device to determine the disconnection of the tracked device according to lack of receipt of the periodically received presence indications in response to separation of the tracking device and the communications device.

5. The platform manager device of claim 3, wherein the platform application is further configured to cause the platform manager device to:

query a data store for at least one of a user-defined location and a point of interest located in proximity to the last known tagged object location of the tracked device; and identify a location name to associate with the last known tagged object location according to the result of the query.

6. The platform manager device of claim 5, wherein the platform application is further configured to cause the platform manager device to identify a distance and direction from the location name to associate with the last known tagged object location.

7. The platform manager device of claim 1, wherein the platform application is further configured to cause the platform manager device to identify one of plurality of associated owner devices as an associated owner device to be provided with the platform notification message according to relative proximity of the associated owner device to the tracked device.

8. The platform manager device of claim 1, wherein the platform application is further configured to cause the platform manager device to:

provide a suggested direction of travel to the associated owner device to locate the tracked device; and cause the associated owner device to enter a roaming tracking mode to listen for an indication of the tagged object while scanning for the tagged object according to suggested direction of travel.

9. A method, comprising:

designating a communication device as being responsible for an object during a user-defined time period, the object being associated with a tracked device;

identifying, by a platform manager device executing a platform application, a last known location of a tracked device according to a detection of a disconnection of the tracked device due to lack of receipt of presence indications;

identifying, by the platform manager device during the user-defined time period, the responsible communications device, among a plurality of communications devices, to receive a platform notification message indicative of the disconnection of the tracked device according to device associations of the tracked device and the communications device; and sending the platform notification message to the identified communications device informing of the detected disconnection.

10. The method of claim 9, further comprising displaying a tagged object location dashboard including: a map, a last known location of the tracked device on the map, and a location of the communications device on the map.

11. The method of claim 9, further comprising:

pairing the tracking device and the communications device using near-field communication;

periodically receiving presence indications from the tracked device while the tracking device and the communications device are paired; and maintaining a last known tagged object location of the tracked device according to the periodically received presence indications.

12. The method of claim 11, further comprising determining the disconnection of the tracked device according to lack of receipt of the periodically received presence indications in response to separation of the tracking device and the communications device.

13. The method of claim 11, further comprising:

querying a data store for at least one of a user-defined location and a point of interest located in proximity to the last known tagged object location of the tracked device; and identifying a location name to associate with the last known tagged object location according to the result of the query.

14. The method of claim 13, further comprising identifying a distance and direction from the location name to associate with the last known tagged object location.

15. The method of claim 9, further comprising identifying one of plurality of associated owner devices as an associated owner device to be provided with the platform notification message according to relative proximity of the associated owner device to the tracked device.

16. The method of claim 9, further comprising:

providing a suggested direction of travel to the associated owner device to locate the tracked device; and entering a roaming tracking mode to listen for an indication of the tagged object while scanning for the tagged object according to suggested direction of travel.

17. A non-transitory computer readable medium storing a tracking application program, the tracking application program being executable by a communications device to provide operations comprising:

designating a communications device as being responsible for an object according a user-defined time period, the object being associated with a tracked device;

forwarding received presence indications to a platform manager device executing a platform application;

receiving a platform notification message, identified by the platform manager device during the user-defined time period, indicative of a detected disconnection of the tracked device associated with the communications device; and displaying a tagged object location dashboard including a map, a last known location of the tracked device included on the map, and a location of the communications device.

18. The non-transitory computer readable medium of claim 17, further providing operations comprising receiving the platform notification message determining the disconnection of the tracked device according to lack of receipt of the forwarded presence indications in response to separation of the tracking device and the communications device.

19. The non-transitory computer readable medium of claim 17, further providing operations comprising:

querying a data store for at least one of a user-defined location and a point of interest located in proximity to the last known tagged object location of the tracked device;

identifying a location name to associate with the last known tagged object location according to the result of the query; and identifying a distance and direction from the location name.

20. The non-transitory computer readable medium of claim 17, further providing operations comprising:

receiving a suggested direction of travel to locate the tracked device; and entering a roaming tracking mode to listen for an indication of the tagged object while scanning for the tagged object according to suggested direction of travel.

* * * * *